United States Patent [19]

Foulkes

[11] Patent Number: 4,726,892

[45] Date of Patent: Feb. 23, 1988

[54] CARBON ANODES

[75] Inventor: Philip B. Foulkes, Wilmette, Ill.

[73] Assignee: Applied Industrial Materials Corporation, Deerfield, Ill.

[21] Appl. No.: 619,664

[22] Filed: Jun. 11, 1984

[51] Int. Cl.[4] ..... C25C 3/06; C25C 3/12

[52] U.S. Cl. ..... 204/294; 373/89; 264/319

[58] Field of Search ..... 204/294; 373/89; 264/319

[56] References Cited

U.S. PATENT DOCUMENTS 3,442,787 5/1969 Landrum ..... 204/294

4,342,637 8/1982 Withers ..... 204/294

*Primary Examiner*—John F. Niebling

[57] ABSTRACT

A prebaked carbon or Soderberg anode for the recovery of aluminum metal from its ores by the process of electrolysis wherein the anode contains comminuted aluminum in an amount of from 0.1 to 2.0 parts by weight per 100 parts by anode material.

5 Claims, No Drawings

CARBON ANODES

This invention relates to improved carbon anodes for electric furnaces. In a particular aspect, this invention relates to prebaked carbon anodes and anodes of the Soderberg type in heating furnaces for metal smelting.

Prebaked anodes are widely used in the electrolytic smelting of aluminum as well as in arc melting and holding furnaces of the steel industry. These anodes are prepared by mixing carbon materials, such as petroleum or recycled carbon material (butts), with a binder, such as coal tar pitch in a ratio of about 7:1–3. The mixture is prepared in a carbon mill and is then formed into rectangular blocks known as green anodes. The green anodes are baked in a suitable furnace or oven at about 1000° C. or more to remove the volatile matter and increase the conductivity. The baked anode is then fitted onto a rod, which can be aluminum, with a cast iron or carbon electrical connection.

During use the carbon anode is maintained in contact with the molten electrolytic bath. In the aluminum industry, for example, such a bath is composed of molten cryolite in which alumina is dissolved. The anode is consumed in the aluminum electrolytic cell at rates of approximately 0.50 lb of carbon for 1.0 lb of aluminum produced. Replacement of the spent anode is done on a periodic basis, the residual carbon (butt) is reprocessed and added to make new green anodes.

The Soderberg process utilizes a single, continuous anode which is baked in situ by the heat of the process. The top is connected with a hopper into which is fed a paste mixture of carbon (such as petroleum coke) and pitch which feeds downwardly to replace the carbon which is being consumed by the process. The heat of the molten bath bakes the carbon-pitch mixture, thus forming a baked anode. The Soderberg anode is widely used in the manufacture of aluminum as well as in submerged arc furnaces for the production of silicon, phosphorous, ferroalloys, e.g. ferrosilicon, and the like.

These anodes have been very successful and are in widespread use at the present time. However, they suffer from certain disadvantages. For example, use of the Soderberg anode results in emission of a large volume of fumes, poor uniformity of conductivity, high resistivity for electrical current and a low yield of carbon by the pitch component. The prebaked anodes require a long baking time at high temperature often with uneven shrinkage. The uniformity of conductivity is poor and resistivity is high.

There is, therefore, a need for improved carbon anodes for metal smelting, especially aluminum smelting.

SUMMARY OF THE INVENTION

It is an object of this invention to provide improved carbon anodes for electric furnaces.

It is another object of this invention to provide improved prebaked carbon anodes and Soderberg-type anodes for electric furnaces used for metal smelting.

It is a third object of this invention to improve the quality and yield of useable pitch carbon during the baking process for both prebaked and Soderberg anodes.

It is a fourth object of this invention to reduce the baking time of prebaked anodes without loss of quality.

Other objects of this invention will be apparent to those skilled in the art from the disclosure herein.

It is the discovery of this invention to provide improved prebaked carbon anodes and anodes of the Soderberg type and processes therefor by incorporating comminuted aluminum in the petroleum coke and coal tar pitch used for preparing the anodes. The addition of the metal increases the yield of carbon during the baking of the electrode and otherwise provides the objects of the invention and overcomes the disadvantages set forth above.

DESCRIPTION OF THE PREFERRED EMBODIMENT

The method of preparing prebaked anodes and anodes of the Soderberg type are well known in the art. Generally these anodes are prepared at the site of use and all that is necessary to practice the invention is to add the comminuted metal directly to the petroleum coke-pitch mixture during the mixing process.

In general, the amount of aluminum to be used should be within the range of about 0.1 lb to 2.0 lb per 100 lbs of petroleum coke-pitch mixture, preferably about 0.5 to 1.0. The aluminum should be comminuted to pass at least 20 mesh sieve size, preferably 100. The metal is added during the mixing of the coke and pitch. Comminuted aluminum is commercially available and the commercial grade is suitable for the practice of this invention.

Any carbon material suitable for aluminum production may be used in the practice of this invention. Petroleum coke is a preferred carbon material because of its low ash content. However, it is known to use a special low-ash anthracite coke. It is understood that the selection of a suitable carbon material and coal tar pitch is known to those skilled in the art and these components do not form a part of the present invention. Carbon materials and coal tar pitch are commercially available. Grades and purities suitable for aluminum smelting are suitable in the practice of this invention.

The invention will be better understood by reference to the following examples. It is understood, however, that the examples are intended only to illustrate the invention and it is not intended that the invention be limited thereby.

EXAMPLE 1

A green anode is prepared as follows. Petroleum coke, 70 lb, and coal tar pitch, 30 lb, are delivered to a carbon mill and 1 lb of 20 mesh comminuted aluminum is added. The mixture is milled for a sufficient period of time to provide uniformity. The mixture is molded into blocks which are then heated to 1000° C.–1200° C. for a period of time sufficient to drive off volatile components. The prebaked anodes thereby obtained are cooled, then fitted with a supporting bar and an electrical connector. They are then used in the production of aluminum.

EXAMPLE 2

A Soderberg anode is prepared as follows. Petroleum coke 70 lb, coal tar pitch 30 lb and comminuted aluminum are mixed in a carbon mill. When the mixture is uniform it is delivered to the hopper of a Soderberg anode. The mixture settles down inside the casing and is baked by the heat of the molten alumina bath, thereby forming the anode. A cast iron stud is driven into the carbon mass to carry the electric current into the anode from the incoming bus bar to which it is attached.

I claim:

1. A prebaked anode made by the steps comprising (a) mixing a carbon material, about 7 parts by weight, coal tar pitch, about 1–3 parts by weight and from about 0.1 to 2.0 parts by weight of comminuted aluminum per 100 parts by weight of the carbon material-coal tar mixture, (b) delivering the mixture to a mold to form it into a rectangular shape, and (c) heating said mixture to over about 1000° C. for a period of time sufficient to drive off volatile matter, thereby forming the anode.

2. A combination suitable for preparing a prebaked carbon anode or a Soderberg anode consisting of a carbon material, about 7 parts by weight, coal tar pitch, about 1–3 parts and from about 0.1 to 2.0 parts by weight of comminuted aluminum per 100 parts of the carbon material-coal tar pitch mixture.

3. The anode of either of claim 1 or 2 wherein the carbon material is petroleum coke.

4. The anode of either of claim 1 or 2 wherein the comminuted aluminum passes at least a 20 mesh sieve.

5. The anode of either of claim 1 or 2 wherein the aluminum is present in an amount of 0.5 to 1.0%.

* * * * *